US005931644A

United States Patent [19]

Glassey et al.

[11] Patent Number: 5,931,644

[45] Date of Patent: Aug. 3, 1999

[54] PRECISION DEMAND AXIAL PISTON PUMP WITH SPRING BIAS MEANS FOR REDUCING CAVITATION

[75] Inventors: Stephen F. Glassey, Ft. Morgan, Colo.; Richard H. Holtman, Dunlap, Ill.

[73] Assignee: Caterpillar Inc., Peoria, Ill.

[21] Appl. No.: 08/847,904

[22] Filed: Apr. 28, 1997

Related U.S. Application Data

[63] Continuation-in-part of application No. 08/423,327, Mar. 30, 1995, abandoned.

[51] Int. Cl.[6] ..... F04B 1/12; F04B 49/03

[52] U.S. Cl. ..... 417/269; 417/295

[58] Field of Search ..... 417/269, 270, 417/295, 222; 92/57, 12.2; 91/489, 499; 62/3

[56] References Cited

U.S. PATENT DOCUMENTS

| | | | |
|---|---|---|---|
| 3,319,568 | 5/1967 | Repko et al. | 103/2 |
| 3,856,438 | 12/1974 | Simko | 417/270 |
| 3,873,240 | 3/1975 | Leduc et al. | 417/222 |
| 4,219,312 | 8/1980 | Mori et al. | 417/295 |
| 4,330,999 | 5/1982 | Nakayama | 62/217 |
| 4,723,891 | 2/1988 | Takenaka et al. | 417/222 |
| 4,730,986 | 3/1988 | Kayukawa et al. | 417/222 |
| 4,744,288 | 5/1988 | Mauch | 92/57 |
| 4,771,676 | 9/1988 | Matsumoto et al. | 92/57 |
| 5,080,561 | 1/1992 | Taguchi | 417/222 |
| 5,085,127 | 2/1992 | Gantzer | 91/499 |
| 5,176,066 | 1/1993 | Kanamaru et al. | 417/269 |
| 5,181,831 | 1/1993 | Teraya | 417/222 |
| 5,213,083 | 5/1993 | Glassey | 123/447 |
| 5,318,410 | 6/1994 | Kawamura et al. | 417/222.2 |
| 5,388,968 | 2/1995 | Wood et al. | 417/295 |
| 5,456,581 | 10/1995 | Jokela et al. | 417/282 |
| 5,572,919 | 11/1996 | Ishizaki | 91/499 |
| 5,630,707 | 5/1997 | Kim et al. | 417/269 |

*Primary Examiner*—Charles G. Freay
*Assistant Examiner*—Robert Z. Evora
*Attorney, Agent, or Firm*—Michael B. McNeil

[57] ABSTRACT

A precision demand axial piston pump with at least one spring for reducing cavitation. The pump includes a drive shaft driven to rotate about a drive axis of rotation. A cylinder block is connected disposed within a casing and is to rotate with the drive shaft and defines a plurality of cylindrical bores arranged parallel to a block axis of rotation. A fixed angle swash plate is positioned adjacent the cylinder block. A valve plate is mounted adjacent the cylinder block and defines an inlet passage and an outlet passage for fluid communication. A plurality of pistons, each having a shoe end, connected to a shoe, and a pressure face end, are slidably received in one of the cylindrical bores. The fixed angle swash plate provides the method for reciprocating the pistons with each revolution of the cylinder block. A throttle valve is positioned to control flow volume through the inlet passage and the pump. The springs have insufficient strength to push the shoe into contact with the swash plate when each of the pistons passes the inlet passage and the throttle valve is partially closed.

11 Claims, 3 Drawing Sheets

PRECISION DEMAND AXIAL PISTON PUMP WITH SPRING BIAS MEANS FOR REDUCING CAVITATION

RELATION TO OTHER PATENT APPLICATION

This application is a continuation-in-part of U.S. patent application Ser. No. 08/423,327, filed Mar. 30, 1995, now abandoned.

TECHNICAL FIELD

The present invention relates generally to axial piston pumps, and more particularly to axial piston pumps with the ability to control flow rate through the pump.

BACKGROUND ART

In general, axial piston pumps have long been known in the art. In one of its simplest forms, an axial piston pump might include a plurality of pistons that reciprocate parallel to the axis of rotation of a cylinder block. The cylinder block of the pump is turned by a drive shaft. The pistons are fitted to bores in the cylinder block, and are connected to piston shoes and a shoe plate, so that the shoes bear against an angled swash plate. As the cylinder block turns, the piston shoes follow the angled swash plate, causing the pistons to reciprocate with each revolution of the cylinder block. Inlet and outlet ports are arranged in a valve plate so that the pistons pass the inlet as they are pulled out and pass the outlet as they are forced back in. The displacement of axial piston pumps is determined by the size and number of pistons, as well as the stroke length, which is determined by the angle of the swash plate. length, which is determined by the angle of the swash plate.

In most applications, the drive shaft for the axial piston pump is connected directly to a power shaft, such as a crank shaft for an engine, so that the drive shaft turns at the same rate as the power shaft. Since in most applications the drive shaft rotation rate is not independently controlled, engineers have sought other ways to control the flow rate through such a pump by varying piston displacement. Variable displacement axial piston pumps are used to pump liquids, such as engine lubricating oil, and typically utilize a moveable yoke that is capable of changing the swash plate angle to increase or decrease piston stroke. The moveable yoke can be positioned by any of several relatively complex means, including manual control, servo control, pressure compensator control, and load sensing and pressure limitor control. The addition of a variable angle swash plate along with the moveable yoke and the mechanisms to drive the same results in an axial piston pump with the ability to control flow rate, but, unfortunately the added complexity and parts renders the variable displacement axial piston pump more vulnerable to failure and requires significantly more maintenance than relatively simple fixed displacement axial piston pumps.

The present invention is directed to providing a relatively simple and robust axial piston pump with the same ability to control flow rate as the relatively problematic variable displacement axial piston pumps of the prior art.

DISCLOSURE OF THE INVENTION

A precision demand axial piston pump includes a drive shaft with a drive axis of rotation. A cylinder block is connected to rotate with the drive shaft and defines a plurality of cylindrical bores arranged parallel to a block axis of rotation. A fixed angle swash plate is positioned in the cylinder block. A valve plate is mounted adjacent the cylinder block and defines an inlet passage and an outlet passage. The inlet passage is in fluid communication with a portion of the cylindrical bores, while the outlet passage is in fluid communication with a different portion of the cylindrical bores. A plurality of pistons, each having a shoe end and a pressure face end, are slidably received in the cylindrical bores. A source of liquid is connected to the inlet passage. The pump includes a throttle valve positioned to control flow volume through the inlet passage of the valve plate. In a preferred embodiment, an electronic control module is in communication with and capable of controlling the throttle valve

Best Mode for Carrying Out the Invention

Figure 1:
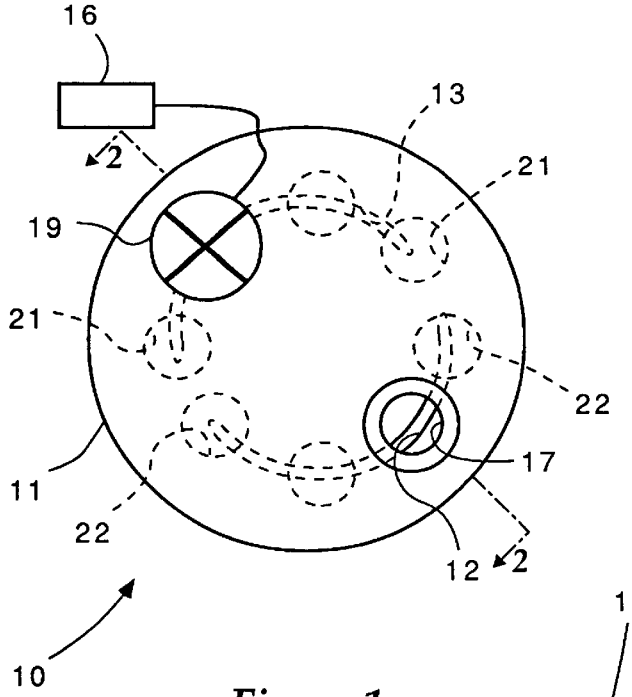
FIG. 1 is an end view of a precision demand axial piston pump according to one embodiment of the present invention.
Figure 2:
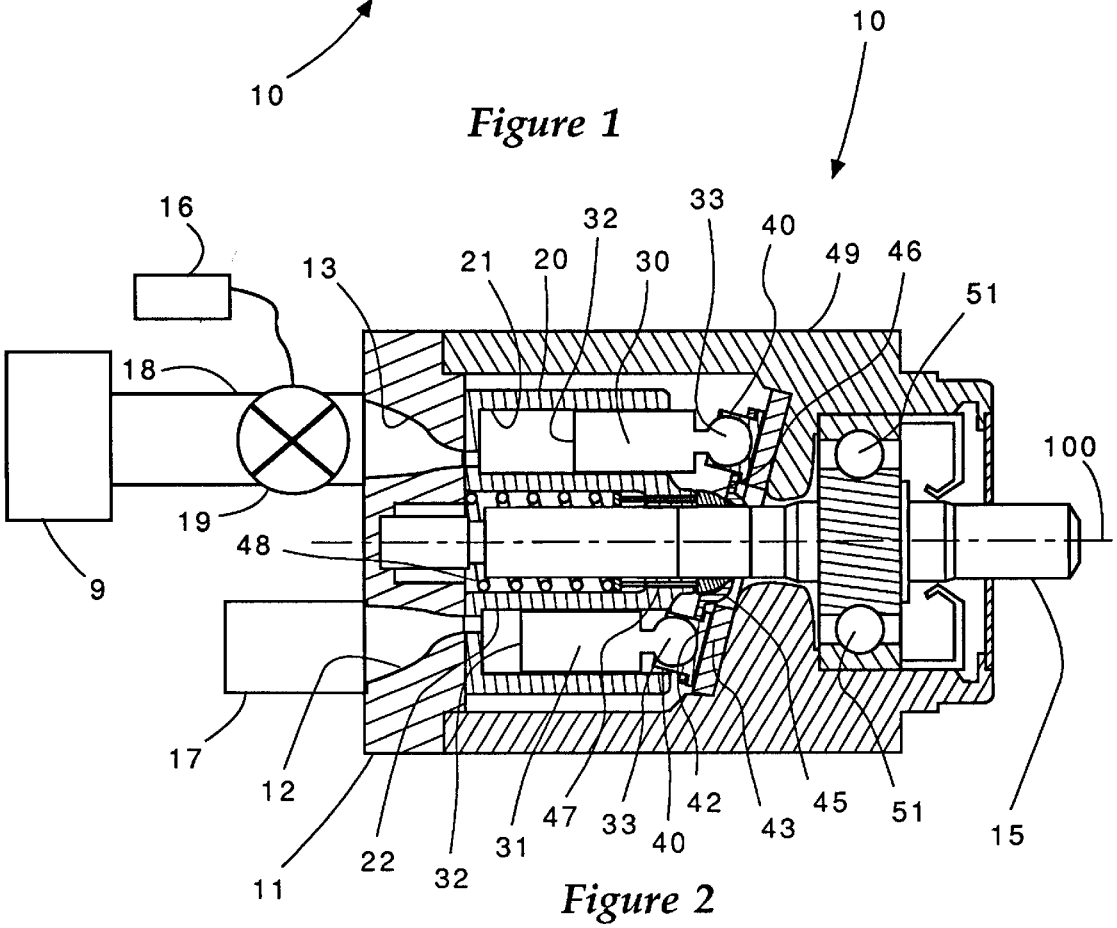
FIG. 2 is a sectioned side elevational view of the precision demand axial piston pump of FIG. 1, as viewed along section lines 2—2.

Referring now to FIGS. 1 and 2, a precision demand axial piston pump 10 includes a drive shaft 15 which is driven to rotate about a drive axis of rotation 100 by a power source, which is not shown. A cylinder block 20 is connected to rotate with drive shaft 15. Cylinder block 20 defines a plurality of cylindrical bores 21, 22 that are arranged parallel to a block axis of rotation, which in this embodiment is co-linear with drive axis 100. A valve plate 11 is mounted adjacent cylinder block 20, and defines an inlet passage 13 and an outlet passage 12. Inlet passage 13 is in fluid communication with a portion of the cylindrical bores 21, while outlet passage 12 is in fluid communication with a different portion of the cylindrical bores 22 (see FIG. 1). A plurality of pistons 30, 31 each have a shoe end 33 and a pressure face end 32. A portion of each piston 30, 31 adjacent its pressure face end 32 is slidably received in one of the cylindrical bores 21, 22.

The shoe end 33 of each piston is held by a shoe 40, which slides along face 42 of fixed angle swash plate 43 when throttle valve 19 is fully open. Shoes 40 are held against swash plate 43 by the action of compression spring 48 acting on a retaining ring 45 via pins 47 and spherical washer 46. Fixed angle swash plate 43 is positioned adjacent cylinder block 20 and attached to a fixed casing 49, which supports bearing 51 that holds drive shaft 15.

With each revolution of drive shaft 15 and cylinder block 20, pistons 30, 31 reciprocate one full cycle. As stated earlier, the angle of swash plate 43 determines the stroke length of the pistons, which in turn determines the displacement of pump 10. As piston 30 moves to the right, fluid is drawn in through inlet 18 and inlet passage 13 into cylindrical bore 21. Inlet 18 is connected to a source of liquid 9. On its downward stroke, the piston 31 pushes fluid out of cylindrical bore 22 into outlet passage 12 and outlet 17. Unlike prior art variable displacement axial piston pumps, pump 10 of the present invention utilizes a throttle valve 19 to control flow volume through the pump. By throttling valve 19, flow rate through inlet 18 and pump 10 can be controlled without the relatively complex variable displacement mechanisms of the prior art. Although throttling valve 19 can be controlled mechanically, in some applications it may be desirable to utilize electronic control via an electronic control module 16 that communicates with valve 19 in a conventional manner. For example, in a vehicular application, electronic control module 16 might control throttling valve 19 based upon a sensed fluid pressure in outlet 17, and the liquid pumped might be lubricating oil.

Figure 3:
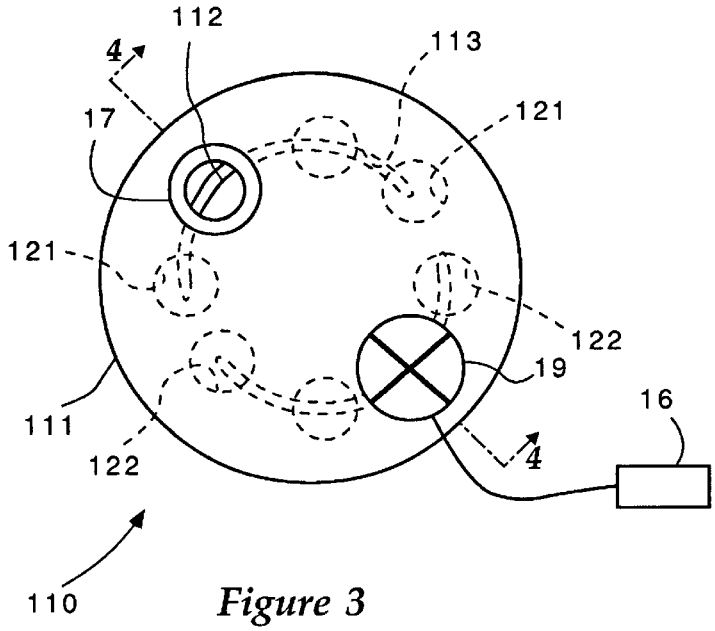
FIG. 3 is an end view of a precision demand axial piston pump according to another embodiment of the present invention.
Figure 4:
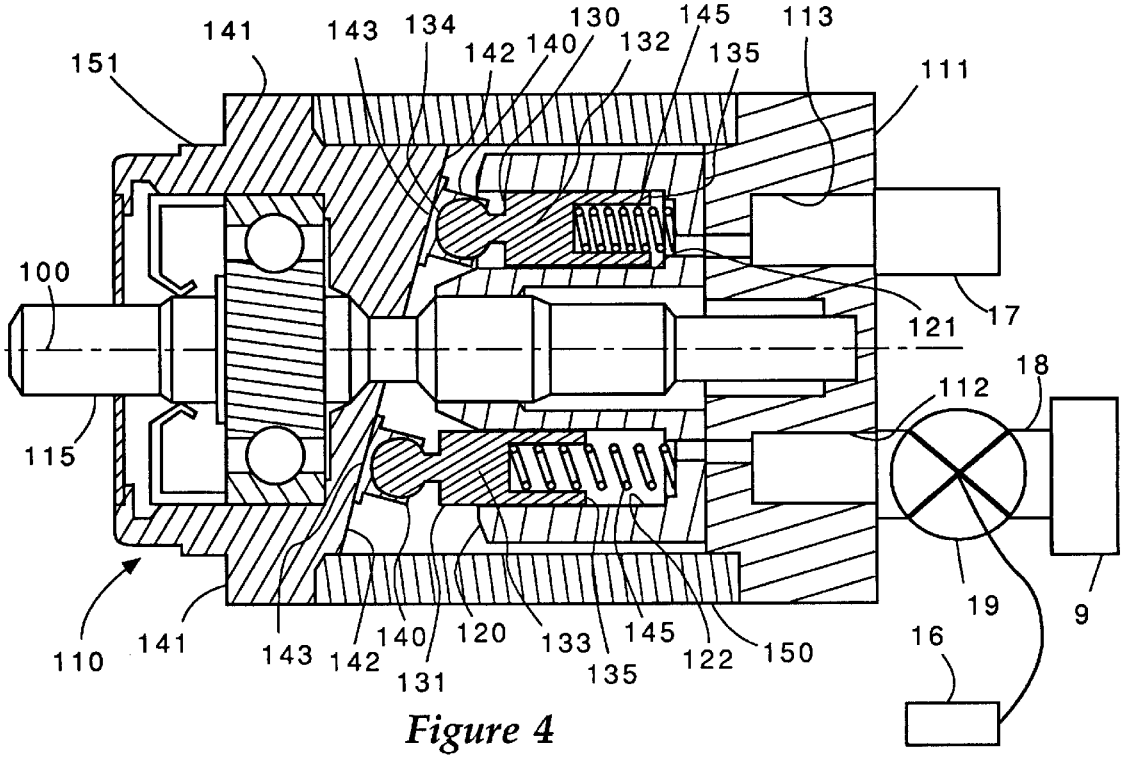
FIG. 4 is a sectioned elevational view of the precision demand axial piston pump of FIG. 3, as viewed along section lines 4—4.

FIGS. 3 and 4 show another precision demand axial piston pump 110, which functions substantially identical to pump 10 shown in FIGS. 1 and 2 but accomplishes piston reciprocation in a different way. Nevertheless, the axial piston pumps shown in FIG. 3 and 4 are generally known as fixed angle swash plate type axial piston pumps. Pump 110 includes a drive shaft 115 that rotates about a drive axis of rotation 100. A cylinder block 120 is connected to rotate with drive shaft 115. The cylinder block defines a plurality of cylindrical bores 121, 122 that are arranged in parallel to a block axis of rotation, which like the earlier embodiment is co-linear with to drive axis 100. A valve plate 111 is mounted adjacent cylinder block 120, and defines an inlet passage 112 and an outlet passage 113. Like the earlier embodiment, the inlet passage 112 of valve plate 111 is in fluid communication with a portion of the cylindrical bores 122, while the outlet passage 113 is in fluid communication with a different portion of the cylindrical bores 121. Inlet passage 112 is connected to a source of liquid 9 via inlet 18. A plurality of pistons 130, 131 each have a shoe end 134 and a pressure face end 135. A portion of each one of the pistons adjacent its pressure face end 135 is slidably received in one of the cylindrical bores 121, 122. Like the earlier embodiment, a throttling valve 19 is positioned to control flow volume through inlet 18 which communicates with inlet passage 112 of valve plate 111. Throttle valve 19 is controlled in opening and closing by electronic control module 16.

Cylinder block 120 is enclosed within a casing 141, 150 which is attached to fixed valve plate 111 in a conventional manner. Drive shaft 115 is supported at one end within valve plate 111 and by a bearing 151 that is supported by casing 141. The shoe end 134 of each piston is held by a shoe 140 with an end surface 143 that slides along slanted face 142 on the internal swash face portion of casing 141. In other words, in this embodiment, casing 141 itself defines the fixed angle swash plate. A compression spring 145 is positioned within each of the cylindrical bores 121, 122, and acts to maintain the individual shoes 140 in contact with slanted face 142 when throttle valve 19 is fully open. Thus, with each revolution of drive shaft 115, pistons 130–133 reciprocate one cycle through the interaction of compression springs 145 and slanted face 142. As in the earlier embodiment, throttling valve 19 controls flow volume through the pump.

Figure 5:
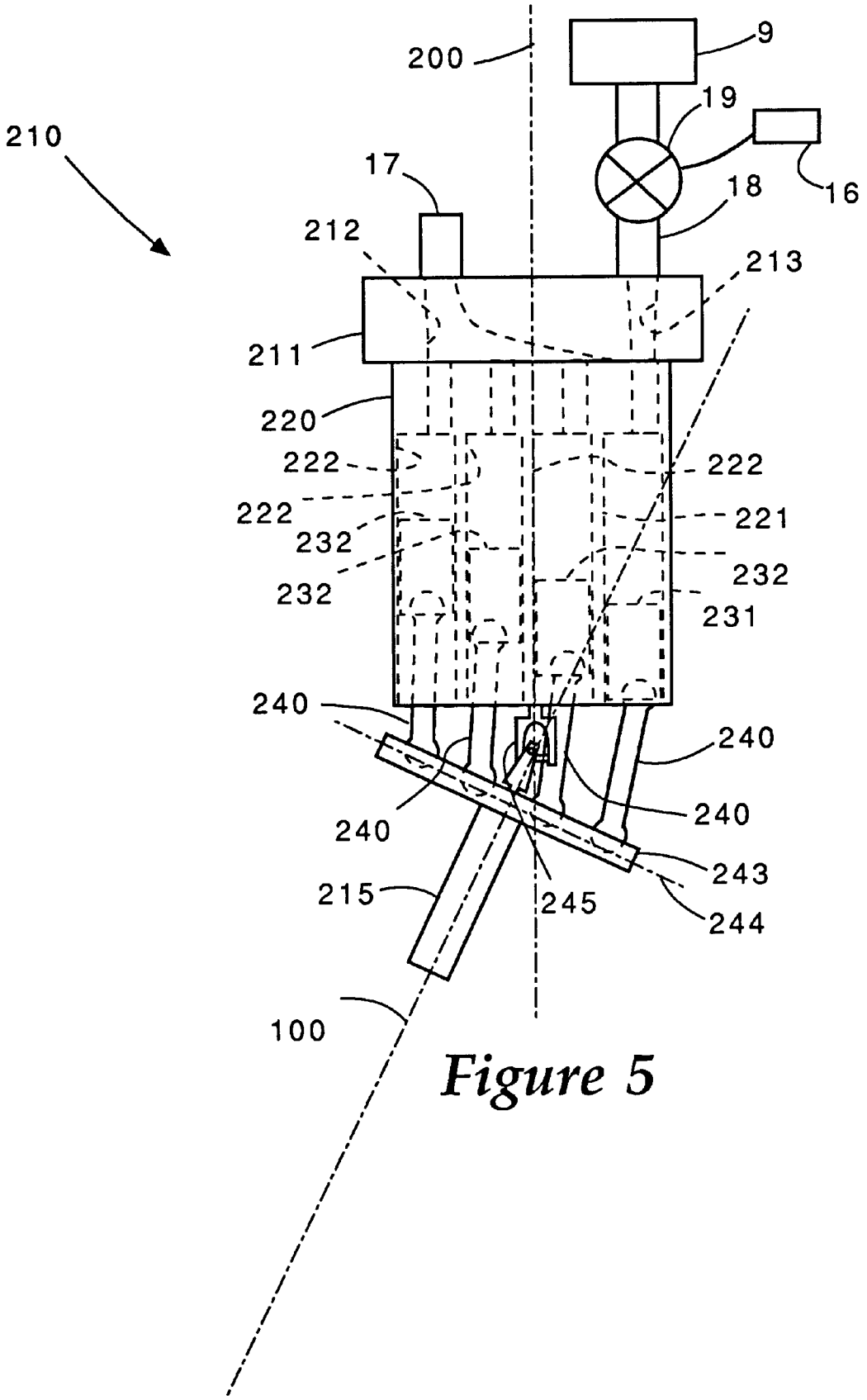
FIG. 5 is schematic side view of a precision demand axial piston pump according to still another embodiment of the present invention.

Referring now to FIG. 5, a bent axis precision demand axial piston pump 210 is shown. Pump 210 functions substantially identical to the earlier embodiments, but drive axis 100 is positioned at a fixed angle with respect to block axis 200, rather than being co-linear. In this case, a plane 244 defined by fixed angle swash plate 243 is perpendicular to drive axis of rotation 100. As in the earlier embodiments, a drive shaft 215 is driven to rotate about drive axis of rotation 100 via a power source that is not shown. Cylinder block 220 is connected via a universal joint 245 to rotate with drive shaft 215 about block axis of rotation 200. Cylinder block 220 defines a plurality of cylindrical bores 221, 222 that are arranged parallel to block axis 200. A plurality of pistons 231, 232 are slidably received in one of the cylindrical bores 221, 222. Each piston has a pressure face end which acts within the cylindrical bores and a shoe end that is attached to a fixed angle swash plate 243 via a piston rod 240. With each rotation of fixed angle swash plate 243 and cylinder block 220, pistons 231, 232 reciprocate through one complete cycle.

A valve plate 211 is mounted adjacent cylinder block 220, and includes an inlet passage 213 and an outlet passage 212 which communicate with inlet 18 and outlet 17, respectively. Inlet 18 is connected to a source of liquid 9. As in the earlier embodiments, inlet passage 213 is in fluid communication with a portion of the cylindrical bores 221, while outlet passage 212 is in fluid communication with a different portion of the cylindrical bores 222. Also like the earlier embodiments, a throttling valve 19 is positioned to control flow volume through inlet 18, which in turn controls flow volume through pump 210. Throttle valve 19 is controlled by an electronic control module 16.

Industrial Applicability

The present invention finds general applicability in any situation utilizing an axial piston pump, and finds specific application as a substitute for the relatively more complex variable displacement axial piston pumps of the prior art. In other words, the present invention can be utilized in any situation where it is desirable to control flow volume through an axial piston pump. For example, the present invention could be utilized as an oil pump for an internal combustion engine system.

In some applications the pump may require some means for reducing cavitation because of the relatively low pressure areas created by the throttling valve. One possible solution to potential cavitation problems might be the utilization of cavitation resistant materials within the pump. For instance, those critical areas that might experience cavitation when the throttle valve is partially closed could be made or lined with one of several hard erosion resistant metallic alloys known in the art. Another solution to a potential cavitation problem might be the use of a resilient element within the pump at a critical area that enlarges as a piston crosses the inlet in order to take up volume that might otherwise cause cavitation to occur. For instance, a portion of the pistons themselves could be made from a resilient material, such as hard rubber, or the pistons could be attached to their individual shoes with tension springs. In the latter case, the pistons could pull away from their respective shoes when passing the inlet so that less liquid is being drawn into the individual cylinder, and thus reducing the likelihood that cavitation pressures could develop.

In the preferred embodiments shown in FIGS. 1–4, potential cavitation problems can be reduced by engineering compression springs 48 and/or 145 to allow the piston shoes to lift off the face of the slanted swash plate. In particular, if cavitation is of concern, the spring 48 of the embodiment shown in FIG. 2 could be made to be sufficiently strong to hold shoes 40 in contact with swash plate 43 when throttle valve 19 is fully open, but have insufficient strength to push the pistons crossing the inlet to their fully retracted positions when throttle valve 19 is partially closed. In addition, the embodiment shown in FIG. 4 could likewise include compression springs 145 that have sufficient strength to push the pistons to follow swash face 142 when throttle valve 19 is completely open, but have insufficient strength to push the pistons and their respective shoes 140 in contact with swash face 142 when throttle valve 19 is partially closed and cavitation is a concern. In such a case, cavitation is reduced since the piston's stroke length is reduced over a portion of its cycle, which results in a smaller displacement and smaller flow volume through the pump.

The above description is intended only to aid in an understanding of the present invention by illustrating several embodiments. Those skilled in the art will immediately appreciate other variations, embodiments and applications suitable to the present invention. In any event, the intended scope of the present invention is defined in terms of the claims as set forth below:

We claim:

1. A precision demand axial piston liquid pump comprising:

a casing;

a drive shaft with a drive axis of rotation;

a cylinder block positioned in said casing and connected to rotate with said drive shaft and defining a plurality of cylindrical bores arranged parallel to a block axis of rotation;

a fixed angle smash plate positioned adjacent said cylinder block;

a valve plate mounted adjacent said cylinder block on a side opposite said fixed angle swash plate and defining an inlet passage and an outlet passage, said inlet passage being in fluid communication with a portion of said cylindrical bores and said outlet passage being in fluid communication with a different portion of said cylindrical bores;

a plurality of pistons having a shoe end and a pressure face end, a portion of each piston adjacent said pressure face end being slidably received in one of said cylindrical bores;

a throttle valve positioned in said inlet passage;

a source of liquid connected to said inlet passage; and means, including at least one spring positioned in said casing, for reducing cavitation in a liquid passing through the pump.

2. The pump of claim 1 further comprising an electronic control module in control communication with said throttle valve, and said throttle valve being electronically controllable by signals transmitted from said electronic control module.

3. The pump of claim 1 wherein said at least one spring is operably positioned to bias said plurality of pistons toward said fixed angle swash plate.

4. The pump of claim 3, wherein said block axis and said drive axis are colinear.

5. The pump of claim 3 further comprising a shoe attached to said shoe end of each of said plurality of pistons.

6. The pump of claim 5 further comprising a retaining ring in contact with each said shoe; and said at least one spring is positioned outside said cylindrical bores and bears against said retaining ring.

7. The pump of claim 6 wherein said at least one spring has insufficient strength to push said shoe into contact with said fixed angle swash plate when each of said plurality of pistons is passing said inlet passage and said throttle valve is partially closed.

8. The pump of claim 5, wherein said at least one spring includes a compression spring positioned in each of said cylindrical bores in contact with said pressure face end of each of said plurality of pistons; and said shoe end of each of said pistons being in contact with said fixed angle swash plate for a portion of each revolution of said cylinder block.

9. The pump of claim 8 wherein each said compression spring has insufficient strength to push said shoe into contact with said fixed angle swash plate when each of said plurality of pistons is passing said inlet passage and said throttle valve is partially closed.

10. The pump of claim 1, wherein said at least one spring is a plurality of compression springs positioned in said cylindrical bores, and each of said compression springs having one end in contact said pressure face end of one of said plurality pistons.

11. The pump of claim 10 wherein each said compression spring has insufficient strength to push said shoe into contact with said fixed angle swash plate when each of said plurality of pistons is passing said inlet passage and said throttle valve is partially closed.

* * * * *

UNITED STATES PATENT AND TRADEMARK OFFICE

CERTIFICATE OF CORRECTION

PATENT NO. : 5,931,644

DATED : August 3, 1999

INVENTOR(S) : Stephen F. Glassey, et al.

It is certified that error appears in the above-identified patent and that said Letters Patent is hereby corrected as shown below:

Please make the following correction to Claim 1:

Column 5, line 23, delete "smash" and insert --swash--

Signed and Sealed this
First Day of February, 2000

*Attest:*

*Attesting Officer*

Q. TODD DICKINSON

*Acting Commissioner of Patents and Trademarks*